US006853816B2

(12) United States Patent
Miyata

(10) Patent No.: US 6,853,816 B2
(45) Date of Patent: Feb. 8, 2005

(54) IMAGE FORMING APPARATUS AND METHOD FOR ADJUSTING MAGNIFICATION OF IMAGE INFORMATION

(75) Inventor: Shungo Miyata, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/421,850

(22) Filed: Apr. 24, 2003

(65) Prior Publication Data

US 2003/0202807 A1 Oct. 30, 2003

(30) Foreign Application Priority Data

Apr. 26, 2002 (JP) ..... 2002-127156

(51) Int. Cl.[7] ..... G03G 15/00; G03G 15/043; G03G 15/041

(52) U.S. Cl. ..... 399/46; 399/51; 399/198

(58) Field of Search ..... 399/196, 198, 399/51, 46; 347/134, 261

(56) References Cited

U.S. PATENT DOCUMENTS 4,456,369 A * 6/1984 Sato
4,839,699 A * 6/1989 Hosaka et al. ..... 399/196
5,028,951 A * 7/1991 Ushio et al.
5,138,369 A * 8/1992 Okubo et al. ..... 399/196

FOREIGN PATENT DOCUMENTS

JP 55142368 A * 11/1980 ..... G03G/15/04
JP 7-177294 A 7/1995
JP 08087221 A * 4/1996 ..... G03G/21/14

* cited by examiner

*Primary Examiner*—Susan Lee
(74) *Attorney, Agent, or Firm*—Foley & Lardner LLP

(57) ABSTRACT

An image forming apparatus includes, a first speed decision unit which decides the driving speed of a drive source of a unit for printing, a magnification adjustment unit which adjusts the magnification of image information by changing the speed of the first speed decision unit, a second speed decision unit which decides the driving speed of a drive source of a carry unit to carry a printing medium, and a speed change interlock unit which changes the speed of the second speed decision unit, when the speed of the first speed decision unit is changed by the magnification adjustment unit.

6 Claims, 4 Drawing Sheets

IMAGE FORMING APPARATUS AND METHOD FOR ADJUSTING MAGNIFICATION OF IMAGE INFORMATION

CROSS-REFERENCE TO RELATED APPLICATIONS

This application is based upon and claims the benefit of priority from the prior Japanese Patent Application No. 2002-127156, filed Apr. 26, 2002, the entire contents of which are incorporated herein by reference.

BACKGROUND OF THE INVENTION

1. Field of the Invention

The present invention relates to an image forming apparatus which can change the magnification of image information when printing the image on a printing medium in the process of electrophotography.

2. Description of the Related Art

There is a conventional image forming apparatus, such as a copier and a printer, which can modify the magnification when printing in the process of electrophotography. The magnification of such image forming apparatus is adjusted by an operator by adjusting the rotation speeds of a plurality of motors, such as a polygon motor and a transfer motor, on shipment or field service. For example, an operator adjusts the speed of a polygon motor when changing the sidewise magnification or the main scanning direction, and adjusts the speeds of a transfer motor, a drum motor, a registration motor and a fixing motor when changing the lengthwise magnification or the subsidiary scanning direction. These magnification adjustments are completed by repeating the adjustment of each motor speed to finally obtain the correct magnification, i.e., adjusting one motor after another, and adjusting the other motor again including the first adjusted one after adjusting one motor.

However, this way of magnification adjustment executed by an operator by repeating the motor speed adjustment causes fluctuation in the time and labor taken for the adjustment, and depends on the operator's skill. Further, when adjusting the magnification in the subsidiary scanning direction, the operator changes the speed setting of a transfer motor, for example, and the paper feed speed changes when passing through a transfer unit. The paper feed speed change when passing through a transfer unit causes a shift between the paper carry speed by the motor of a carry system used for feeding the paper, causing a paper jam in the paper carrying path.

Therefore, there is a need for an image forming apparatus which can easily adjust the magnification, and prevent a paper jam in the paper carrying path, at the same time.

BRIEF SUMMARY OF THE INVENTION

According to an aspect of the prevent invention, there is provided an image forming apparatus comprising, a first speed decision unit which decides the driving speed of a drive source of a unit for printing, a magnification adjustment unit which adjusts the magnification of image information by changing the speed of the first speed decision unit, a second speed decision unit which decides the driving speed of a drive source of a carry unit to carry a printing medium, and a speed change interlock unit which changes the speed of the second speed decision unit, when the speed of the first speed decision unit is changed by the magnification adjustment unit.

Objects and advantages of the invention will become apparent from the description which follows, or may be learned by practice of the invention.

BRIEF DESCRIPTION OF THE SEVERAL VIEWS OF THE DRAWING

The accompanying drawings illustrate embodiments of the invention, and together with the general description given above and the detailed description given below, serve to explain the principles of the invention.

DETAILED DESCRIPTION OF THE INVENTION

An embodiment of the present invention will be explained hereinafter with reference to the attached drawings.

In this embodiment, an image forming apparatus according to the present invention is applied to a copier 1.

Figure 1:
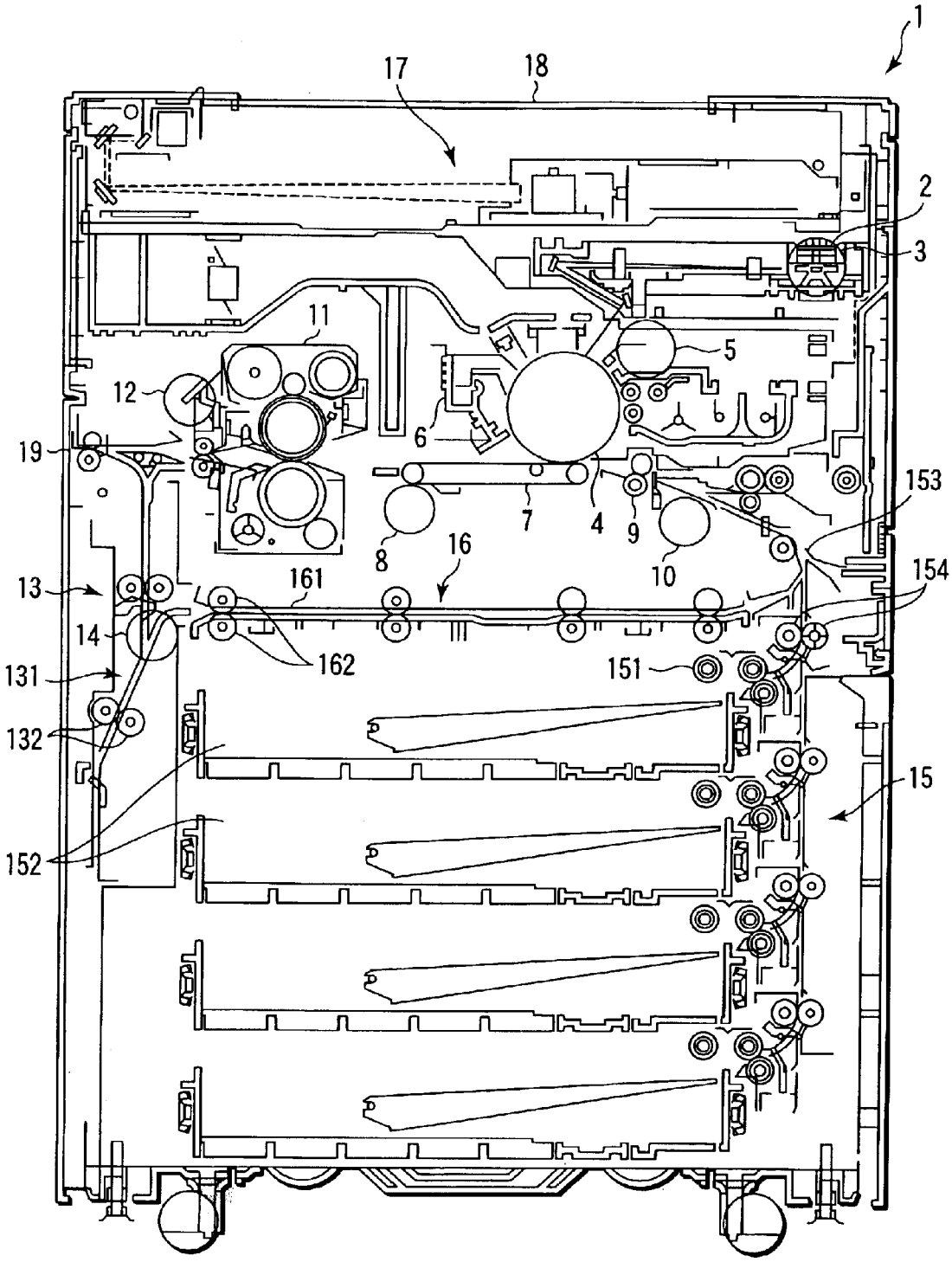
FIG. 1 is a schematic diagram showing the positions of the motors of each unit of a copier according to one embodiment of the present invention.

FIG. 1 is a sectional view of a copier 1. The copier 1 is provided with a polygon motor 3 which is a drive source of a polygon mirror provided in an exposing unit 2, a drum motor 5 which is a drive source of a photoconductive drum 4, a developing unit 6, a transfer belt motor 8 which is a drive source of a transfer belt which transfers paper, a registration motor 10 which is a drive source of a registration roller 9 which corrects the paper inclination and adjusts the paper end to a developer image, a fixing motor 12 which is a drive source of a fixing roller of a fixing unit 11, a reverse motor 14 which is a drive source of a reverse roller of a reverse unit 13, a paper feed unit 15, a carry unit 16, a scanner 17, a document table 18 to stack documents, and an ejection port 19 to eject paper.

Figure 2:
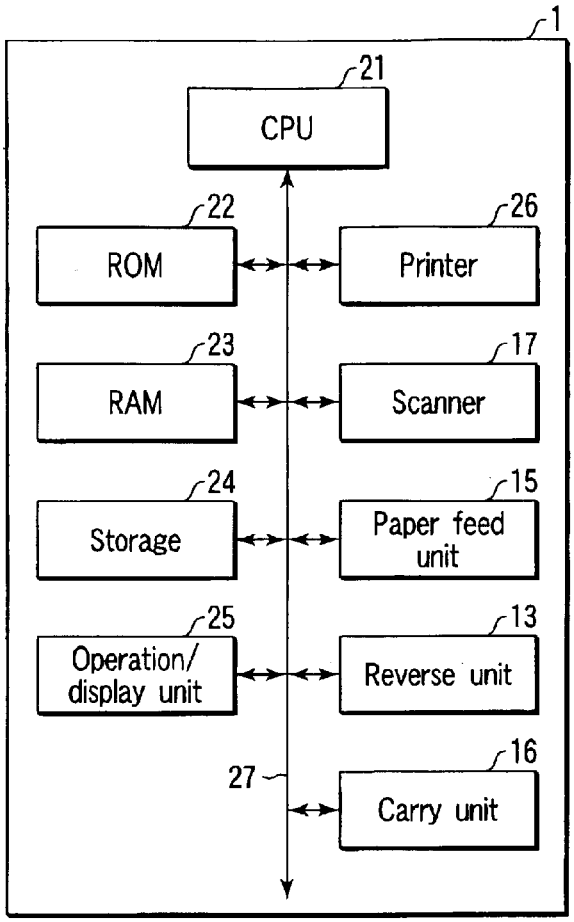
FIG. 2 is a block diagram showing the configuration of the main part of the copier.

FIG. 2 is a block diagram showing the configuration of the main part of the copier 1. The main part of the copier 1 comprises a CPU 21, a ROM 22, a RAM 23, a storage 24, an operation/display unit 25, a print unit 26, a scanner 17, a paper feed unit 15, a reverse unit 13, and a carry unit 16. The CPU 21, ROM 22, RAM 23, storage 24, control/display unit 25, print unit 26, scanner 17, paper feed unit 15, reverse unit 13 and carry unit 16 are connected via a bus line 27 such as a system bus.

The CPU 21 realizes the operation as a copier 1 by executing the control operation to generally control each unit, based on the control program stored in the ROM 22.

The ROM 22 stores the control program executed by the CPU 21. The control program stored in the ROM 22 includes a magnification adjustment mode to adjust the magnification of images by changing the speeds of each motor. This magnification adjustment mode is available in a printer (PRT) system 31 for the magnification adjustment in the structure not including the scanner 17, and a copy (PPC) system 32 for the magnification adjustment in the structure including the scanner 17. The magnification adjustment mode is for the magnification adjustment in these two systems. The RAM 23 includes a work area to store the data necessary for the CPU 21 to execute various processes.

The storage 24 is DRAM or hard disk drive with a large capacity, for example. The storage 24 temporarily stores the image information read by the scanner 17. The storage 24 also stores the formulas to determine the speeds of the polygon motor 3, transfer belt motor 8, drum motor 5, registration motor 10, fixing motor 12 and reverse motor 14, in each of the PRT system 31 and PPC system 32.

The operation/display unit 25 has a key input section to accept the operator's various instruction inputs for the CPU 21. The operator operates the key input section to perform various operations for the above-mentioned magnification adjustment mode (a magnification adjustment section). The operation/display unit 25 also has a display to indicate under the control of CPU 21 various information to be notified to the operator.

The scanner 17 reads the document image by accepting the copy start instruction from the operation/display unit 25, after the document is stacked on the document table 18 and the document table cover (not shown) is closed by a user.

The print unit 26 prints a predetermined image information read by the scanner 17 in the process of electrophotography by driving and controlling the polygon motor 3, transfer belt motor 8, drum motor 5, registration motor 10, and fixing motor 12.

Namely, a static latent image of a predetermined image information is formed on the photoconductive drum 4 by the exposure on the photoconductive drum 4 of the exposing unit 2 and the rotation of the photoconductive drum 4. The developing unit 6 supplies developer to the static latent image, and forms a developer image. Paper is fed from the registration roller 9 to the transfer belt 7, so that the end of the developer image comes to the end of the printing position, and the developer image is transferred to the paper by the rotation of the transfer belt 7 and photoconductive drum. The fixing unit 11 fixes the developer image transferred to the paper. Printing is performed in this way.

The paper feed unit 15 picks up the paper loaded in a paper cassette 52 by a pickup roller 151, delivers the paper to a paper feed path 153 extended up to the registration roller 9, and carries the paper up to the registration roller 9 by driving a paper feed roller 154.

The reverse unit 13 switches the carry path and once stores the image fixed paper delivered from the fixing unit 11, and ejects the paper from the ejection port 19 by reversely rotating a reverse roller 132. Namely, the paper is ejected with the printed side faced down when one side of the paper is printed.

The carry unit 16 switches the carry path and delivers the paper once loaded in a container 131 of the reverse unit 13 to the carry path 161, and carries the paper to the registration roller 9 by a carry roller 162, when printing both sides of the paper.

Figure 3:
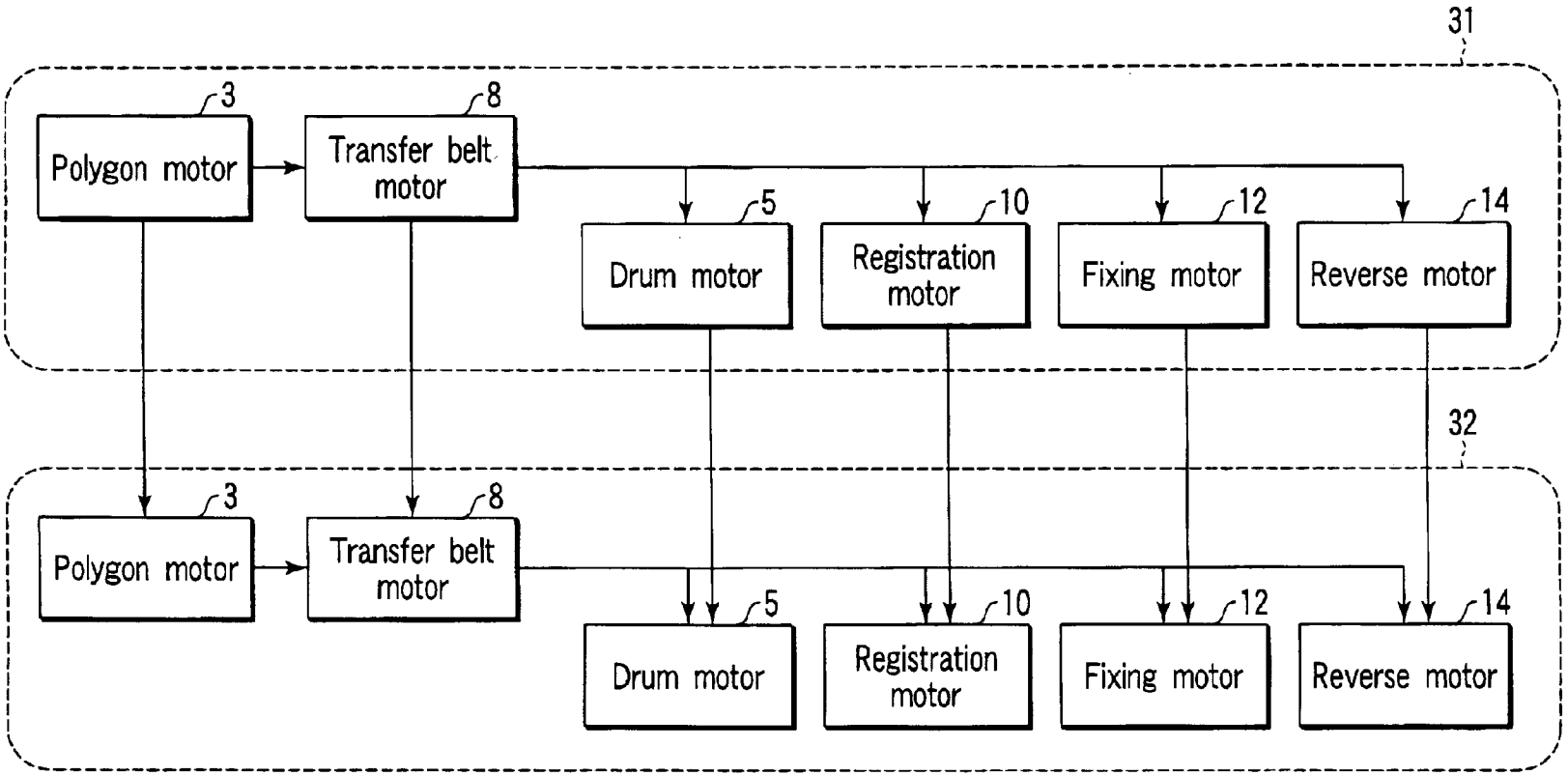
FIG. 3 is a view for explaining the hierarchical relationship among the speed changes of each motor of the copier.

Next, the relationship among the speeds of each motor will be explained by referring to FIG. 3.

Figure 4:
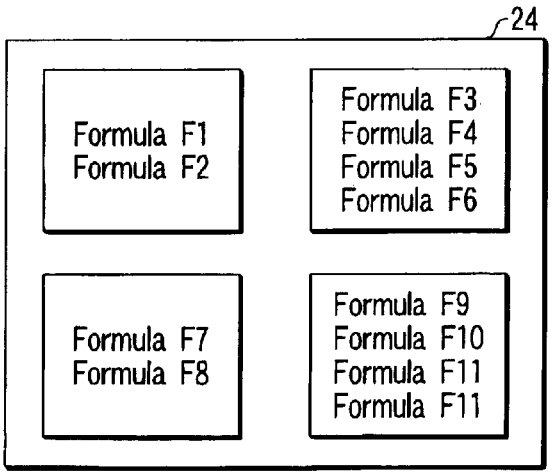
FIG. 4 is a view showing the formulas to calculate the speeds to be stored in a memory.

In the PRT system 31, assume that a formula for calculating the speed of the polygon motor 3 is F1, a formula for calculating the speed of the transfer belt motor 8 is F2 (a first speed decision unit), a formula for calculating the speed of the drum motor 5 is F3, a formula for calculating the speed of the registration motor 10 is F4, a formula for calculating the speed of the fixing motor 12 is F5, and a formula for calculating the speed of the reverse motor 14 is F6 (a second speed decision unit), respectively. Further, in the PPC system 32, assume that a formula for calculating the speed of the polygon motor 3 is F7, a formula for calculating the speed of the transfer belt motor 8 is F8 (a first speed decision unit), a formula for calculating the speed of the drum motor 5 is F9, a formula for calculating the speed of the registration motor 10 is F10, a formula for calculating the speed of the fixing motor 12 is F11, and a formula for calculating the speed of the reverse motor 14 is F12 (a second speed decision unit), respectively. These formulas F1 to F12 are stored in a part of the storage 24, as shown in FIG. 4.

First, the interlocking relationship among the speeds of each motor in the PRT system 31 will be explained. Assuming that the speed determined by the formula F1 for the polygon motor 3 in the PRT system 31 is V1, this speed V1 is included in the formula F2 as an element to determine the speed of the transfer belt motor 8. Assume that the speed calculated by the formula F2 is V2. This speed V2 of the transfer belt motor 8 is included in the formula F3 for the drum motor 5, the formula F4 for the registration motor 10, the formula 5 for the fixing motor 12 and the formula F6 for the reverse motor 14, respectively, as an element to determine the speed. Assume that the speed calculated by the formula 3 is V3, the speed calculated by the formula 4 is V4, the speed calculated by the formula 5 is V5, and the speed calculated by the formula 6 is V6.

Therefore, when the speed V1 of the polygon motor 3 is changed, the speed V2 of the transfer belt motor 8, the speed V3 of the drum motor 5, the speed V4 of the registration motor 10, the speed V5 of the fixing motor 12 and the speed V6 of the reverse motor 14 are automatically adjusted. When the speed V2 of the transfer belt motor 8 is changed, the speed V3 of the drum motor 5, the speed V4 of the registration motor 10, the speed V5 of the fixing motor 12 and the speed V6 of the reverse motor 14 are automatically adjusted. The element to determine the speed included in the formula F1 to F6 is not limited to this element for automatic adjustment by the relationship among the speeds, and includes also the element for the adjustment by receiving the operator's instruction for each of the formulas F1 to F6.

Next, the relationship among the speeds of each motor in the PPC system 32 will be explained. The magnification adjustment in the PPC system 32 accepts the influence of the change in the speeds of each motor in the PRT system 31, as shown in FIG. 3.

The formula F7 of the polygon motor 3 in the PPC system 32 includes the speed V1 of the polygon motor 3 in the PRT system 31, as an element to determine the speed. Assume that the speed calculated by the formula F7 is the speed V7. Further, the formula F8 of the transfer belt motor 8 includes, as elements determining for the speed, the speed V7 of the polygon motor 3, the speed V2 of the transfer belt motor 8 and the speed V1 of the polygon motor 3, both in the PRT system 31. Assume that the speed calculated by the formula F8 is the speed V8.

The formula F9 of the drum motor 5 includes, as elements determining for the speed, the speed V8 of the transfer belt motor 8 in the PPC system 32, the speed V3 of the drum motor and the speed V1 of the polygon motor 3, both in the PRT system 31. Assume that the speed of the drum motor 5 calculated by the formula 9 is the speed V9.

The formula F10 of the registration motor 10 includes, as elements determining for the speed, the speed V8 of the transfer belt motor 8 in the PPC system 32, the speed V4 of the registration motor 10 and the speed V1 of the polygon motor 3, both in the PRT system 31. Assume that the speed of the registration motor 10 calculated by the formula F10 is the speed V10.

The formula F11 of the fixing motor 12 includes, as elements determining for the speed, the speed V8 of the transfer belt motor 8 in the PPC system 32, the speed V5 of the fixing motor 12 and the speed V1 of the polygon motor 3, both in the PRT system 31. Assume that the speed of the fixing motor 12 calculated by the formula F11 is the speed V11.

The formula F12 of the reverse motor 14 includes, as elements determining for the speed, the speed V8 of the transfer belt motor 8 in the PPC system 32, the speed V6 of the reverse motor 14 and the speed V1 of the polygon motor 3, both in the PRT system 31. Assume that the speed V12 calculated by the formula F12 is the speed V12.

Therefore, since the speeds of each motor in the PPC system 32 includes the speeds of each motor in the PRT system 31 as an element to determine the speed, the speeds V7 to V12 are automatically adjusted by changing the element. In the automatically adjusted state, when the magnification of the PPC system 32 is adjusted and as in the case of changing the speed of the PRT system 31, when the speed V7 of the polygon motor 3 is changed, the speed V8 of the transfer belt motor 8 is automatically adjusted, and further, the speeds V9 to V12 of the drum motor 5, registration motor 10, fixing motor 12 and reverse motor 14 are automatically adjusted. Further, in the magnification adjustment in the PPC system 32, when the speed V8 of the transfer belt motor 8 is changed without changing the speed V7 of the polygon motor 3, the speeds V9 to V12 of the drum motor 5, registration motor 10, fixing motor 12 and reverse motor 14 are automatically adjusted. The element to determine the speed included in the formulas F7 to F12 is not limited to the element for the automatic adjustment by the relationship among the speeds, and includes the element for the adjustment by receiving the operator's instruction for each of the calculation formulas F7 to F12.

Figure 5:
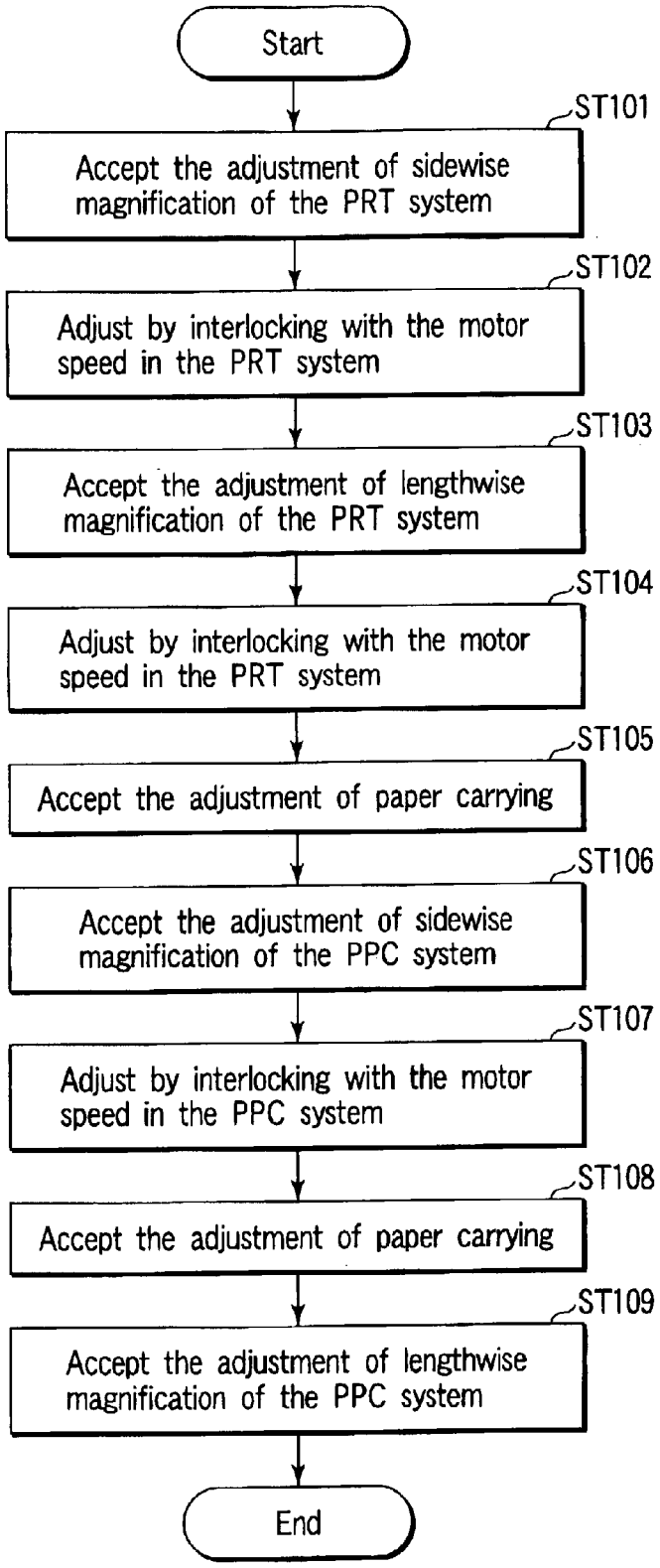
FIG. 5 is a flow chart showing the process of adjusting the magnification of the copier.

Description will now be given on the case of magnification adjustment of the copier 1 by the operator's operation of the operation/display unit 25 with reference to the flow chart of FIG. 5.

The operator first adjusts the magnification in the PRT system 31. The operator outputs the grid pattern of the fixed data stored in the ROM 22, for example, and based on the output image, the operator first adjusts the sidewise magnification or the main scanning direction. The operator measures the pitch of the horizontal grid pattern from the output image, and determines the speed V1 of the polygon motor 3, for which the speed change per a step is previously set.

When the operator changes the default value of the speed V1 of the polygon motor 3 for adjustment of the sidewise magnification according to the output result of the grid pattern (step ST101), the speeds V2 to V12 of the polygon motor 3, transfer belt motor 8, drum motor 5, registration motor 10, fixing motor 12 and reverse motor 14 are automatically adjusted to meet the change in the speed V1 (step ST102).

Then, the operator adjusts the lengthwise magnification or the subsidiary scanning direction. When the operator changes the speed V8 of the transfer belt motor 8 for adjustment of the lengthwise magnification (step ST103), the speeds V3 to V6 and the speeds V8 to V12 of the transfer belt motor 8, drum motor 5, registration motor 10, fixing motor 12 and reverse motor 14 are automatically adjusted to meet the change in the speed V2 (step ST104).

In this time, because of the structural dimensional variations in the machine body of each copier or the fractions in calculations, the exact magnification may not be obtained only by the automatic adjustment. Thus, after each motor speed is automatically adjusted, output and print the whole surface halftone previously stored in the ROM 22, and check that no transfer blur or jam occurs. If any defect is found, the operator change the speed of a part of each formula F, which is not automatically adjusted, and adjust the speed from the cooperation/display unit 25 (step ST105). When the length and width of the grid pattern is outputted as 100%×100%, it is unnecessary to change the default value.

Next, the operator adjusts the magnification of the PPC system 32. In the PPC system 32, the magnification is adjusted by the image information read from the scanner 17.

First, the operator copies the image read from the scanner 17, reads the sidewise magnification or the main scanning direction, and adjusts the magnification (step ST106). This adjustment is performed by adjusting the polygon motor 3. When the speed V7 of the polygon motor 3 is changed by the operator, the speeds V8 to V12 of the transfer belt motor 8, drum motor 5, registration motor 10, fixing motor 12 and reverse motor 14 are automatically adjusted to meet the change in the speed V7 (step ST107).

The paper carry speed in the PPC system 32 is adjusted by the adjustment of the above-mentioned motor speeds, including the structural variations, but the speed may not be properly adjusted because of the fractions in calculations. Thus, the operator outputs the halftone of the image read by the scanner, and checks whether a transfer blur occurs. If any defect occurs, the operator makes fine adjustment by giving the predetermined instruction from the operation/display unit 25. This can adjust the sidewise magnification or the main scanning direction and the paper carry speed (step ST108).

Next, when the lengthwise magnification or the subsidiary scanning direction in the PPC system 32 is incorrect due to the read error of the scanner 17, for example, after the adjustment of step ST108 is finished, the operator copies a scale or the like and adjusts the lengthwise magnification to 100% (step ST109).

According to this embodiment, when the speeds of the motors ranked high are changed upon the magnification adjustment by the operator, the speeds of the motors ranked low are automatically adjusted. Namely, when the speeds of the motor ranked high are changed, the magnification is automatically adjusted, and the magnification of the copier 1 can be efficiently adjusted regardless of whether the operator is skilled or not.

Further, in adjustment of the magnification of the copier 1, when the polygon motor 3 and transfer belt motor 8 which are ranked high in the motor speed are changed, the reverse motor 14 which is ranked low is automatically adjusted. Therefore, before shipment of the copier or after the magnification adjustment by field service, even the printing by using the reverse unit 13, for example, when printing one side of paper and ejecting the paper with the printed side faced down, or when printing both sides of paper, a paper jam does not occur in the reverse unit 13.

Further, though the description is started from when the operator changes the speed V1 of the polygon motor 3, when it is unnecessary to adjust the sidewise magnification of the image information, it is permitted to start the magnification adjustment by changing the lengthwise magnification of the image information, that is, the speed V2 of the transfer belt motor 8.

In the copier 1 described above, an embodiment of the invention, the magnification is adjusted in the PRT system 31 and the PPC system. Nonetheless, the invention is not limited to this embodiment. Rather, the invention can be applied to a copier that has no scanning function, i.e., a copier that has the PRT system 31 only. Further, the invention can be applied to magnification adjustment is not only monochromatic copier, but also in color image forming apparatus.

Further, though the speeds V6 and V12 of the reverse motor 14 of the reverse unit 13 are automatically adjusted when the magnification of the copier 1 is adjusted by the operator, it is also allowable that the motor speeds of the paper feed unit 15 and carry unit 16 are automatically adjusted interlocking with the magnification adjustment. That is, the motor speed of the carry system used for carrying paper can be automatically adjusted interlocking with the magnification adjustment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the invention as defined by the appended claims and equivalents thereof.

What is claimed is:

1. A method of adjusting magnification of an image comprising:

changing a first driving speed of a drive source of an exposure unit which adjusts sidewise magnification of image information and a transfer unit which adjusts lengthwise magnification of the image information;

adjusting the magnification of the image information by changing the first driving speed; and changing a second driving speed of a drive source of a carry unit which carries a printing medium, in accordance with the change of the first driving speed.

2. An image forming apparatus, comprising:

a first speed decision unit which decides a driving speed of a drive source of an exposure unit which adjusts sidewise magnification of image information and a transfer unit which adjusts lengthwise magnification of the image information;

a magnification adjustment unit which adjusts magnification of the image information by changing the driving speed decided by the first speed decision unit;

a second speed decision unit which decides a driving speed of a drive source of a carry unit which carries a printing medium; and a speed charge interlock unit which changes the driving speed decided by the second speed decision unit, when the driving speed decided by the first speed decision unit is changed by the magnification adjustment unit.

3. The image forming apparatus according to claim 2, further comprising a scanner which reads an image of a document and generates an image information, wherein the magnification adjustment unit adjusts the magnification of the image information generated by the scanner.

4. A method of adjusting magnification of an image comprising:

changing a first driving speed of a drive source of an exposure unit which adjusts sidewise magnification of image information and a transfer unit which adjusts lengthwise magnification of the image information;

adjusting the sidewise magnification of the image information by changing the first driving speed;

changing a second driving speed of a drive source of a carry unit which carries a printing medium, in accordance with the change of the first driving speed to adjust the sidewise magnification;

adjusting the lengthwise magnification of the image information by changing the first driving speed; and changing the second driving speed of the drive source of the carry unit, in accordance with the change of the first driving speed to adjust the lengthwise magnification.

5. An image forming apparatus comprising:

a magnification adjustment unit which adjusts magnification of image information;

a polygon motor speed control unit which changes a speed of a polygon motor in accordance with the magnification adjusted by the magnification adjustment unit; and a transfer speed control unit which changes a speed of a transfer unit in accordance with the change of the speed of the polygon motor.

6. The image forming apparatus according to claim 5, further comprising a carrying speed control unit which changes a carrying speed at which a printing medium is carried, in accordance with the change of the speed by the transfer speed control unit.

* * * * *